US009279170B2

(12) United States Patent
Pabel et al.

(10) Patent No.: US 9,279,170 B2
(45) Date of Patent: Mar. 8, 2016

(54) METHOD FOR THE REFINING AND STRUCTURE MODIFICATION OF AL-MG-SI ALLOYS

(75) Inventors: Thomas Pabel, Leoben (AT); Peter Schumacher, Leoben (AT)

(73) Assignee: SAG MOTION GmbH, Lend (AT)

( * ) Notice: Subject to any disclaimer, the term of this patent is extended or adjusted under 35 U.S.C. 154(b) by 195 days.

(21) Appl. No.: 14/114,989

(22) PCT Filed: May 3, 2012

(86) PCT No.: PCT/AT2012/000124

§ 371 (c)(1),
(2), (4) Date: Jun. 20, 2014

(87) PCT Pub. No.: WO2012/149589

PCT Pub. Date: Nov. 8, 2012

(65) Prior Publication Data

US 2014/0290437 A1 Oct. 2, 2014

(30) Foreign Application Priority Data

May 3, 2011 (AT) ..... A 615/2011

(51) Int. Cl.

| | |
|---|---|
| ***C22C 21/08*** | (2006.01) |
| ***C22C 1/00*** | (2006.01) |
| ***C22C 1/02*** | (2006.01) |
| ***C22C 1/03*** | (2006.01) |

(52) U.S. Cl.
CPC . *C22C 1/00* (2013.01); *C22C 1/026* (2013.01); *C22C 1/03* (2013.01); *C22C 21/08* (2013.01)

(58) Field of Classification Search
CPC ..... C22C 21/08; C22C 1/00
See application file for complete search history.

(56) References Cited

U.S. PATENT DOCUMENTS

| | | | | |
|---|---|---|---|---|
| 8,337,644 | B2 * | 12/2012 | Trenda | C22C 21/08 148/440 |
| 2001/0010242 | A1 * | 8/2001 | Lee | C22C 21/04 148/549 |
| 2010/0074796 | A1 * | 3/2010 | Franke | C22F 1/05 420/535 |
| 2010/0326619 | A1 * | 12/2010 | Kim | B21J 5/00 164/460 |

* cited by examiner

*Primary Examiner* — George Wyszomierski
*Assistant Examiner* — Tima M McGuthry Banks
(74) *Attorney, Agent, or Firm* — Cozen O'Connor

(57) ABSTRACT

A method for the refining and structural modification of Al—Mg—Si alloys for permanent-mold casting or sandcasting, which Al—Mg—Si alloys have the general composition of 5.0-10.0 weight % Mg; 1.0-5.0 weight % Si; 0.001-1.0 weight % Mn, 0.01-0.2 weight % Ti, less than 0.001 weight % Ca, less than 0.001 weight % Na, and less than 0.001 weight % Sr, and as the remainder, Al, and wherein phosphorus is added to the alloy melt in a quantitative range of from 0.01 to 0.06 weight %, referred to the total mass of the alloy.

6 Claims, No Drawings

METHOD FOR THE REFINING AND STRUCTURE MODIFICATION OF AL-MG-SI ALLOYS

RELATED APPLICATIONS

This is a U.S. national stage of application No. PCT/AT2010/000124, filed on May. 3, 2012. Priority is claimed on the following application: Austria Application No.: A 615/2011 filed on May. 3, 2011, the disclosure contents of which are hereby incorporated by reference.

FIELD OF THE INVENTION

The present invention relates to a method for the refining and structural modification of Al—Mg—Si alloys.

BACKGROUND OF THE INVENTION

Alloys of the Al—Mg—Si type are preferentially used in diecasting processes, and they are especially advantageous for producing thin-walled components.

For example, for an Al—Mg—Si alloy of the following general composition: 5.0-6.0 weight % Mg, 1.8-2.6 weight % Si, 0.5-0.8 weight % Mn, and Al as the remaining ingredient, the breaking elongation [A5] is 16% for components with a wall thickness of 4 mm, 7% with a wall thickness of 18 mm, and only 4% with a wall thickness of 24 mm. Thus in workpieces produced by diecasting, a pronounced worsening of the breaking elongation with increasing wall thickness is found.

Furthermore, it is known that workpieces of alloys of the Al—Mg—Si type that have been produced by permanent-mold casting or sandcasting have poor mechanical properties, in particular with regard to their breaking elongation.

For instance, if an alloy having the following general composition: 4.5-6.5 weight % Mg, 1.5 weight % Si, 0.45 weight % Mn, and Al as the remaining ingredient, is used in permanent-mold casting or sandcasting, the breaking elongation [A5] is 3% for a workpiece with a wall thickness of 20 mm produced by sandcasting, and also 3% for a workpiece with a wall thickness of 16 mm produced by permanent-mold casting. Thus comparably poor breaking elongation values to those in diecasting are obtained.

To improve the mechanical properties of components, among other things particle refining treatments can be performed.

In diecasting, a particle refining treatment is generally unnecessary and can even have adverse effects. The solidification conditions in diecasting, and especially the high cooling rate, already effectively counteract particle growth. However, in the prior art, a treatment with melt treatment salts that contain halogen, such as $MgCl_2$, or so-called, active gases, such as chlorine gas with nitrogen or argon, in various concentrations are known for achieving a fine microstructure and thus good mechanical properties.

It is moreover known that the microstructure of Al—Mg—Si alloys, in particular for diecasting, can be controlled by adding alloy elements such as Mn, Cr and Zr; see ASM Specialty Handbook: Aluminum and Aluminum Alloys, 1993, ASM International, p. 44.

From all the data sheets for the applicable alloys and in the literature, it can be learned that any addition of phosphorus, whether intentional or not, is to be avoided, since it counteracts an advantageous microstructural development and thus makes the mechanical properties of workpieces of these alloys worse.

Conversely, what is known in the prior art is an addition of phosphorus to Al—Si—Mg alloys; see for example ASM Specialty Handbook Aluminum and Aluminum. Alloys, 1993, ASM International. p. 44. The term Al—Si—Mg, in contrast to Al—Mg—Si, means that such an alloy has a higher proportion of Si than Mg.

The addition of phosphorus is done especially in near-eutectic and supereutectic Al—Si—Mg alloys. Supereutectic Al—Si—Mg alloys are alloys with an Si content that is slightly, or considerably, more than 12% Si. With a content of 12% Si. the alloy is exclusively eutectic, in the form of a fine-grained Al—Si mixed crystal.

In supereutectic Al—Si—Mg alloys, as the alloy melt cools, coarse-grained Si crystals develop first, which are subsequently embedded in the fine-grained mixed crystal structure. Because of the coarse Si crystals, the mechanical properties become worse. Adding AlP makes these Si crystals finer, since AlP acts as a nucleating agent for Si crystals, which are therefore present in markedly smaller sizes in the resultant structure, thereby improving the mechanical properties.

Conversely, adding phosphorus to subeutectic Al—Si—Mg alloys is ineffective, since as these alloys cool, α Al crystals form first, not Si crystals, and the eutectic Al—Si alloy forms after that.

SUMMARY OF THE INVENTION

Surprisingly, it has now been found that adding phosphorus to an Al—Mg—Si alloy of the kind that can be used in dicasting can improve the mechanical properties, in particular the breaking elongation, in workpieces with greater wall thicknesses, if these workpieces are made from the phosphorus-containing alloys by permanent-mold casting or sandcasting processes.

Accordingly, one aspect of the present invention is directed to a method for refining Al—Mg—Si alloys for permanent-mold casting or sandcasting, which Al—Mg—Si alloys have the general composition of 5.0-10.0 weight % Mg; 1.0-5.0 weight % Si; 0.001-1.0 weight % Mn, 0.01-0.2 weight % Ti, less than 0.001 weight % Ca, less than 0.001 weight % Na, and less than 0.001 weight % Sr, and as the remainder, Al, and phosphorus is added to the alloy melt in a quantitative range of from 0.01 to 0.06 weight %, referred to the total mass of the alloy.

For use with the method of the invention, Al—Mg—Si alloys which have the general composition of 6-9 weight % Mg; 2.5-4.5 weight % Si; 0.02-0.5 weight % Mn, 0.01-0.2 weight % Ti, less than 0.001 weight % Ca, less than 0.001 weight % Na, and less than 0.001 weight % Sr, and as the remainder, Al, are particularly preferred.

Thus for an alloy having the composition of 7.88-7.06 weight % Mg, 4.53-4.60 weight % Si, 0.017-0.018 weight % Min, 0.0003-0.0007 weight % Ca, and less than 0.0001 weight % of Na and Sr each, and Al as the remainder, for a workpiece with a wall thickness of 25 mm, produced by permanent-mold casting, the following breaking elongation values are have been measured:

| | P content in weight % | Breaking elongation A5 (%) |
|---|---|---|
| Specimen 1 | 0.0004 (that is, with a P content as in the prior art in diecasting) | 1.3 |

-continued

| | P content in weight % | Breaking elongation A5 (%) |
|---|---|---|
| Specimen 2 | 0.0078 | 3.8 |
| Specimen 3 | 0.0129 | 9.3 |
| | (P content per the invention) | |

From the above table, it can be seen that workpieces having the phosphorus addition according to the invention (specimen 3) have an improvement in the breaking elongation by a factor of more than 7, compared to the prior art (specimen 1).

Without being tied to the theory, it is assumed that the phosphorus addition ensures that the eutectic alloy grows in decoupled fashion. As a result, the morphology of the eutectic $Mg_2Si$ phase changes, from lamellar and coarse to globular and fine. It is assumed that the phosphorus binds the calcium and thus suppresses the formation of the intermetallic phases $CaMg_2$, $Al_2Ca$, $Al_4Ca$, and so forth. These phases are nucleation points for the eutectic $Mg_2Si$, and if they are not present, the nucleation points are missing at the host level, and the $Mg_2Si$ phase occurs from supercooling. Since for each individual particle, nucleation is necessary, the growth proceeds extremely slowly, compared to unmodified alloys. The nucleation is effected independently or on the aluminum, which however is a poor nucleating agent and thus minimized the speed of growth. In thermal analysis, the peak of the ternary eutectic alloy disappears or decreases with an increasing phosphorus content.

Adding the phosphorus can be done in the form of a phosphorus master alloy or phosphorus-yielding salt mixtures. Preferred phosphorus master alloys which can be used according to the invention include $CuP_8$, AlCuP, AlFeP and FeP master alloys.

The production according to an embodiment of the invention of an alloy with improved mechanical properties for permanent-mold casting or sandcasting is done by the following plan:

melting pure aluminum or suitable secondary aluminum of sufficient quality (for instance, AlMg sheets)

alloying up silicon, magnesium, and titanium by adding pure metals (silicon, magnesium, titanium) or so-called master alloys, for instance of 90% aluminum and 10% titanium determining the melt composition (for instance by spark emission spectrometry)

purifying the melt by adding purifying salts (such as MgCl2), by cleavage with active gas mixtures (such as Ar:Cl2 98:2) or inert gases (such as N2 or Ar). The goal of the metal purification is the removal of oxides, hydrogen and trace contaminants, such as sodium and calcium adjusting the melt temperature to 730-780° C.

alloying up the phosphorus to 0.01-0.06% by adding $CuP_8$, AlCuP, AlFeP or FeP master alloys monitoring the chemical composition and correcting it as needed by another addition of alloy elements adjusting the casting temperature pouring of the melt by horizontal continuous casting or some other suitable method such as casting in permanent molds (so-called pig casting line) or by the Properzi process.

The invention claimed is:

1. A method for the refining and structural modification of Al—Mg—Si alloys for permanent-mold casting or sandcasting, which Al—Mg—Si alloys have the general composition of 5.0-10.0 weight % Mg; 1.0-5.0 weight % Si; 0.001-1.0 weight % Mn, 0.01-0.2 weight % Ti, less than 0.001 weight % Ca, less than 0.001 weight % Na, and less than 0.001 weight % Sr, and as the remainder, Al, and comprising adding phosphorus to a melt of the alloy in a quantitative range of from 0.01 to 0.06 weight %, referred to the total mass of the alloy.

2. The method of claim 1, wherein the phosphorus added in the form of phosphorus master alloys or phosphorus-yielding salt mixtures.

3. The method of claim 2, wherein the phosphorus master alloys include $CuP_8$,AlCuP, AlFeP and FeP master alloys.

4. The method of claim 3, wherein the Al—Mg—Si alloys have the general composition of 6-9 weight % Mg; 2.5-4.5 weight % Si; 0.02-0.5 weight % Mn, 0.01-0.2 weight % Ti, less than 0.001 weight % Ca, less than 0.001 weight % Na, and less than 0.001 weight % Sr, and as the remainder, Al.

5. The method of claim 2, wherein the Al—Mg—Si alloys have the general composition of 6-9 weight % Mg; 2.5-45 weight % Si; 0.02-0.5 weight % Mn, 0.01-0.2 weight % Ti, less than 0.001 weight % Ca, less than 0.001 weight % Na, and less than 0.001 weight % Sr, and as the remainder, Al.

6. The method of claim 1, wherein the Al—Mg—Si alloys have the general composition of 6-9 weight % Mg; 2.5-4.5 weight % Si; 0.02-0.5 weight % Mn, 0.01-0.2 weight % Ti, less than 0.001 weight % Ca, less than 0.001 weight % Na, and less than 0.001 weight % Sr, and as the remainder, Al.

* * * * *